US005087028A

United States Patent [19]

Fröhlich

[11] Patent Number: 5,087,028

[45] Date of Patent: Feb. 11, 1992

[54] ALIGNING TABLE

[75] Inventor: Eckhard Fröhlich, Steinheim, Fed. Rep. of Germany

[73] Assignee: Stahl GmbH & Co. Maschinenfabrik, Fed. Rep. of Germany

[21] Appl. No.: 401,956

[22] Filed: Sep. 1, 1989

[30] Foreign Application Priority Data

Mar. 1, 1989 [DE] Fed. Rep. of Germany ... 8902453[U]

[51] Int. Cl.[5] ..... B65H 5/00

[52] U.S. Cl. ..... 271/273; 271/240

[58] Field of Search ..... 271/239, 240, 229, 253-255, 271/272, 274, 273, 22, 23, 249, 252; 226/15, 18-20, 179, 185, 192

[56] References Cited

U.S. PATENT DOCUMENTS 2,274,834 3/1942 Ira ..... 271/274 X
2,696,983 12/1954 Anderson ..... 271/240
3,709,484 1/1973 Kistner ..... 271/255 X
4,506,879 3/1985 Goodwin ..... 271/240 X
4,529,189 7/1985 Konishi ..... 271/22

*Primary Examiner*—Richard A. Schacher
*Attorney, Agent, or Firm*—Frost & Jacobs

[57] ABSTRACT

An aligning table such as e.g. used in feeders for folding and printing machines comprising a lower sheet guide and an upper sheet guide which is defined by two side walls which extend in the conveying direction and between which a plurality of holding-down elements likewise aligned in the conveying direction are arranged, is improved such that the side walls are connected together by at least one guide bar which extends perpendicularly to said walls and on which the holding-down elements are slidingly mounted, whereby interfering sheets of paper, paperboard, cardboard or the like can simply and rapidly be removed from the aligning table without applying high forces.

11 Claims, 4 Drawing Sheets

ALIGNING TABLE

BACKGROUND OF THE INVENTION

The invention relates to an aligning table as is employed for conveying and simultaneous alignment of sheets of paper, paperboard, cardboard or the like, for example in feeders for folding and printing machines.

THE PRIOR ART

Aligning tables according to the prior art comprise a lower sheet guide over which the sheets to be conveyed slide with their lower side. Said lower sheet guide is formed in many constructions by transport rolls or rollers extending transversely to the conveying direction. The conveyed sheets slide with their entire width over the transport rolls or rollers. In other embodiments the sheet transport means, preferably ball-loaded belts or bands, lie under the sheet lower side only in the region of narrow strips extending in the conveying direction, the greater part of the sheet lower side in the conveying direction sliding over stationary strips, spring bands or profile rods,(for example U-profile rods).

The sheets running with high speed over the aligning table have a tendency to lift off the lower sheet guide of the aligning table and rise up. In known constructions of the aligning tables the lifting of the sheets off the lower sheet guide is prevented by a corresponding upper sheet guide lying tightly over the sheets. Said upper sheet guide also consists preferably of profile rods arranged in the longitudinal direction, the distance between the profile rods and the sheet surface and the spacings between the individual profile rods having to be exactly set in each case to correspond to the sheet width and the nature of the paper.

In spite of exact setting however it repeatedly occurs that sheets on the aligning table tilt or that double sheets on the table must be stopped. Removal of such interfering sheets is very complicated in aligning tables according to the prior art. Thus, aligning tables are known in which to remove interfering sheets the holding-down bars of the upper sheet guide must be removed individually and when the trouble has been eliminated mounted again exactly at the same point and aligned. In other aligning tables the holding-down bars in the upper sheet guide are anchored in a frame which as a whole can be slightly pivoted upwardly. The height of the upward pivoting is however usually greatly restricted by components arranged thereabove and consequently only a lateral narrow gap is available for removing the sheets. However, removal of the sheets through such a narrow gap is complicated and time-consuming. Moreover, a great force must be applied for the manual pivoting up of the entire frame of the upper sheet guide with the holding-down bars arranged therein.

The invention is based on the problem of improving aligning tables according to the preamble in such a manner that interfering sheets can be simply and rapidly removed from the aligning table without applying high forces.

SUMMARY OF THE INVENTION

This problem is solved in an aligning table comprising a lower sheet guide and an upper sheet guide which is defined by two side walls which extend in the conveying direction and between which a plurality of holding-down elements likewise aligned in the conveying direction are arranged in accordance with the invention in that the side walls are connected together by at least one guide bar which extends perpendicularly to said walls and on which the holding-down elements are slidingly mounted. In an aligning table configured according to the invention the holding-down elements of the upper sheet guide, for removing an interfering sheet, can be simply pushed along the guide bar towards one side of the upper sheet guide in the manner of Venetian blinds so that the interfering sheet is freely accessible from above and can be removed simply and rapidly without applying appreciable force.

Advantageous embodiments of the invention are characterized by the features of the subsidiary claims. Accordingly, the holding-down elements of the upper sheet guide can resume their starting position automatically again after removal of an interfering sheet. According to a further advantageous embodiment the holding-down elements can be held by a manually releasable detent mechanism in the position pushed to one side for removing the sheet.

BRIEF DESCRIPTION OF THE DRAWINGS

Further details, features and advantages of the invention will be apparent from the following description of the examples of embodiment illustrated in the drawings, wherein.

DETAILED DESCRIPTION OF THE INVENTION

Figure 1:
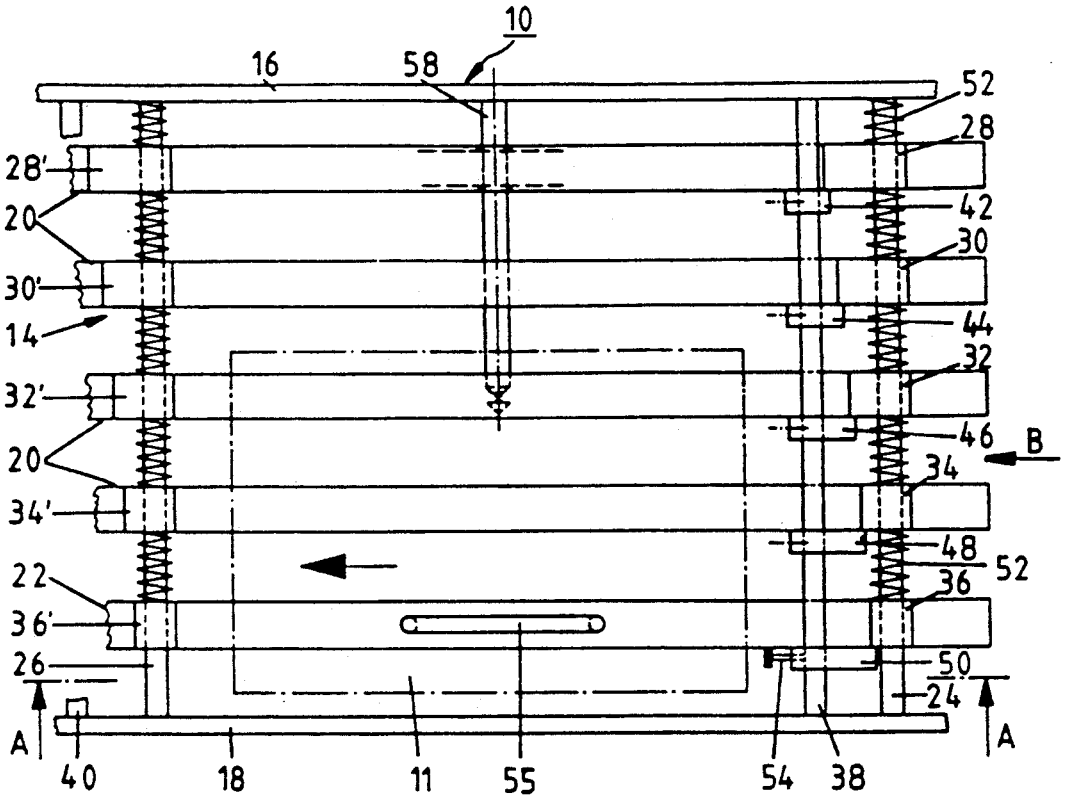
FIG. 1 is a partially sectioned schematic plan view of a first embodiment of an aligning table according to the invention.

In FIG. 1 the upper sheet guide 14 is shown in its working position, i.e. a sheet 11 is transported in the direction of the arrow over the aligning table 10. In the working position five holding-down elements 20 and 22 of the upper sheet guide 14 are arranged substantially uniformly spaced apart between the side walls 16 and 18 defining the upper sheet guide 14. The holding-down elements 20 and 22 are mounted displaceably on two guide bars 24 and 26 which are aligned perpendicularly to the side walls 16 and 18 and thus extend transversely of the conveying direction of the aligning table 10. The holding-down elements 20 and 22 are mounted via slide blocks 28, 30, 32, 34, 36 on the guide rod 24 and via slide blocks 28', 30', 32', 34' and 36' respectively on the guide rod 26. The slide blocks have blocking areas of different size. Thus, the slide blocks 28 and 28' via which the holding-down element 20 adjacent the side wall 16 is mounted on the guide bars 24 and 26 has the largest blocking area. The following slide blocks 30, 32, 34 and 36 and 30', 32', 34' and 36' have respectively incrementally smaller blocking areas.

Stops 42, 44, 46, 48 and 50 arranged on a stop guide bar 38 extending parallel to the guide bar 24 correspond to the slide blocks described above and further stops (not shown in the drawing) are arranged on a stop guide bar 40 extending parallel to the guide bar 26. The stops also have areas of different size, the stops 42 arranged adjacent the side wall 16 having the smallest blocking area and the blocking area increasing from stop to stop with increasing distance from the side wall 16. The blocking faces of the slide blocks and stops are adapted to each other in such a manner that in the working position each slide block lies on a corresponding stop associated therewith. Thus, the slide blocks 28 and 28' with the greatest blocking area bear on the stop elements 42 with the smallest blocking area, the slide blocks 30 and 30' bear on the stop elements 44, etc., down to the side blocks 36 and 36' with the smallest blocking area which bear on the stops 50 with the largest blocking areas. The blocking area gradations are made such that the slide blocks when shifted laterally out of the working position shown in FIG. 1 do not come into contact with the other stops which are not associated with them. Thus, for example, the slide blocks 36 and 36', which of course in the working position engage the stops 50, can be pushed past the stops 48, 46, 44 and 42 without the respective blocking faces coming into engagement with each other.

On the guide bars 24 and 26 in each case between the side wall 16 and the slide blocks 28 and 28' and between the slide blocks 28 and 28' and 30 and 30', 30 and 30' and 32 and 32', 32 and 32' and 34 and 34' and finally 34 and 34' and 36 and 36' respective pressure springs 52 are arranged. The pressure springs 52 act on the respective slide blocks and thus the holding-down elements 20 and 22 in such a manner that in the working position they bear on the respective associated stops.

Figure 2:
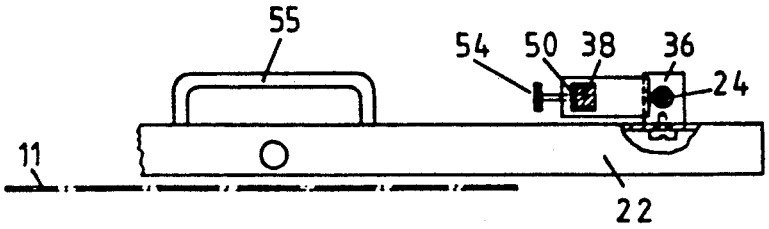
FIG. 2 is a fragmentary view, partially in section, along the line A—A of FIG. 1.

In FIG. 2 the outermost holding-down element 22 is shown. FIG. 2 shows in detail how the sliding block 36 bears on the stop 50. The sliding block 36 is connected via a screw connection to the outermost holding-down element 22. The same applies of course to the remaining slide blocks and their corresponding holding-down elements. Like the remaining stops 42, 44, 46 and 48 the stop 50 is detachably fixed via locking screws 54 on the respective stop guide bar 38, 40. Due to this easily detachable connection the stops and thus the holding-down elements 20 and 22 bearing thereon can be arranged at any time in any desired position transversely of the conveying direction. The stop guide bars 38 and 40 are made as square profiles to which square openings in the stops correspond so that after release of the respective locking screw 54 for displacement of the stops there is only one degree of freedom, i.e. in the direction of the axes of the stop guide bars 38 and 40. This prevents an undesirable turning of the stops in the peripheral direction. The outermost holding-down element 22 additionally comprises a grip 55 with which said element and thus also the remaining holding-down elements 20 can be pushed laterally away from their stop position.

Figure 3:
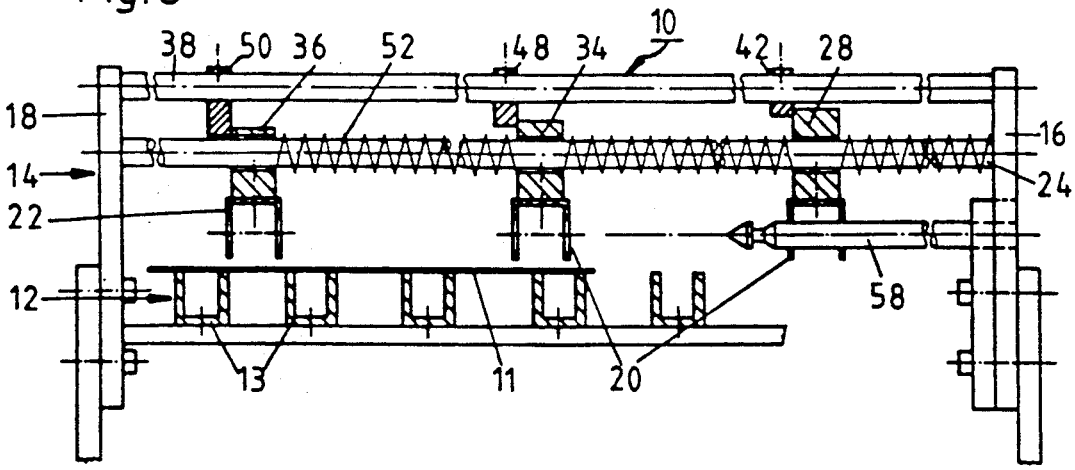
FIG. 3 is a view in the direction of the arrow B in FIG. 1, partially in section, with however the stop guide bars not adjacent but above the guide bars.

FIG. 3 shows how the sheet 11 to be transported in the aligning table 10 is arranged between the lower sheet guide 12 and the upper sheet guide 14. The sheet 11 slides over narrow sides of U-profiles 13 of the lower sheet guide 12 open towards the sheet. Just above the continuous sheet 11 holding-down elements 20 and 22 are arranged. In the embodiment shown here the holding-down elements 20, 22 also consist of U-profiles which are open towards the sheet upper side.

Figure 4:
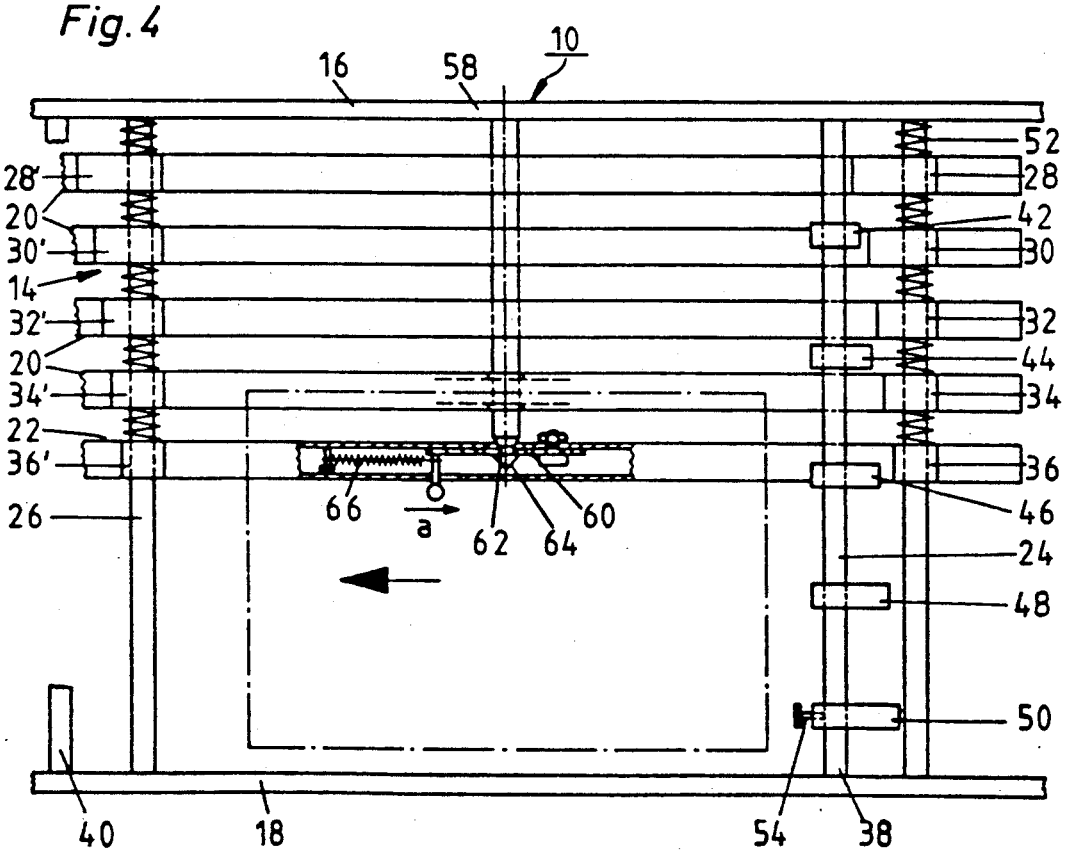
FIG. 4 is a plan view corresponding to FIG. 1, the holding-down elements being shown in their laterally displaced locked position.

In FIG. 4 the holding-down elements 20 and 22 of the upper sheet guide are displaced laterally out of their working position into the removal position. The holding-down elements are held in this position against the spring force of the pressure springs 52 by a detent or lock mechanism. The detent mechanism consists of a detent bolt 58 which extends from the side wall 16 transversely of the conveying direction and a blocking slide 60 which is arranged in the outermost holding-down element 22. For locking engagement the blocking slide 60 snaps into a groove 62 which is formed near the free end of the detent bolt 58 formed as tip 64. The blocking slide 60 is held by a tension spring 66 in locking engagement with the detent bolt 58. The blocking slide 60 can be moved against the spring force of the tension spring 66 in the direction of the arrow a to release the locking engagement so that said blocking slide moves out of its locking position into a release position.

Figure 5:
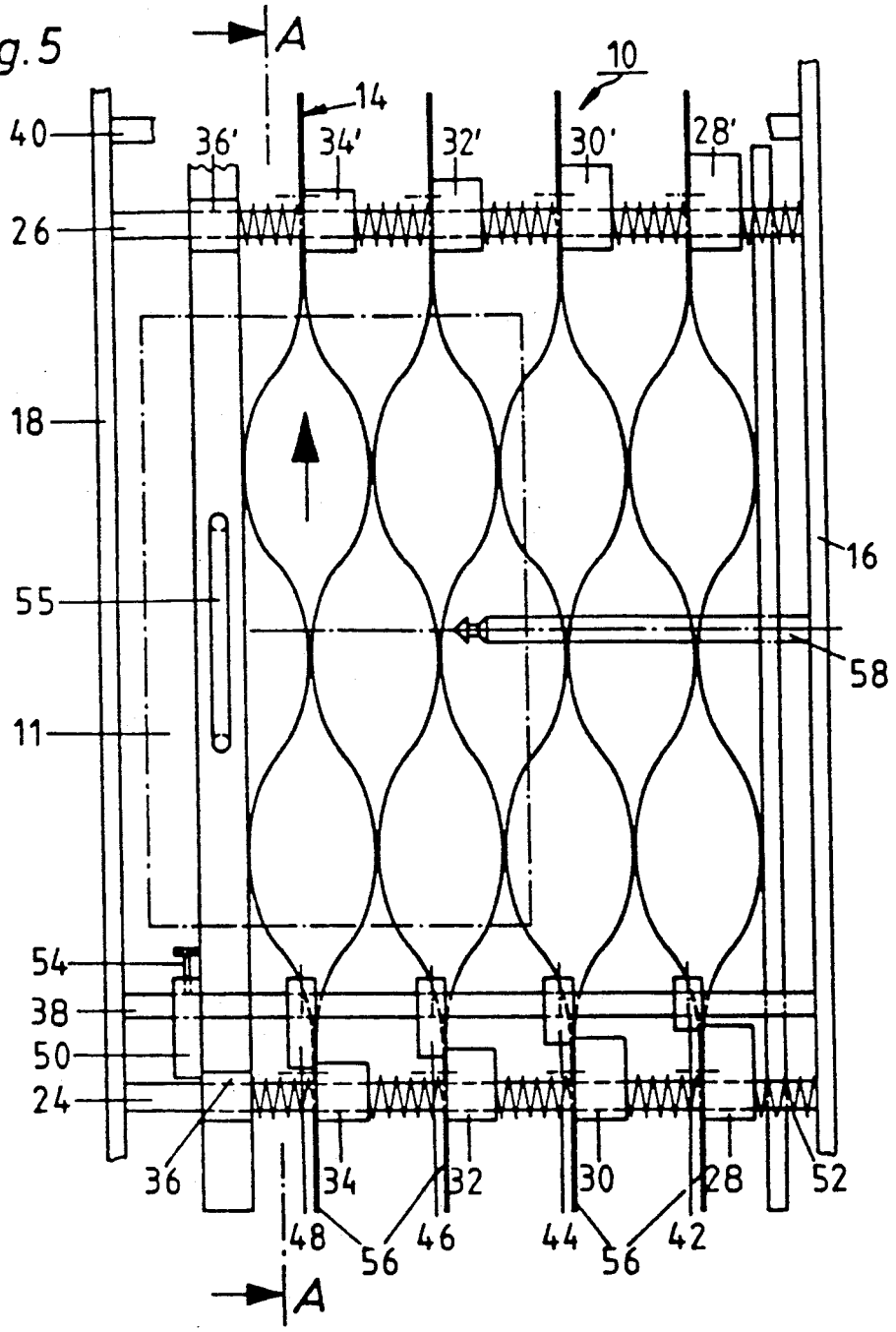
FIG. 5 is a partially sectioned schematic plan view of a further embodiment of the aligning table according to the invention.
Figure 6:
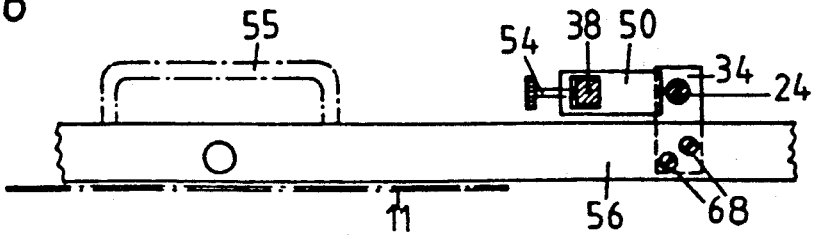
FIG. 6 is a fragment of a sectional view along the line A—A of FIG. 5

In FIG. 5 a second embodiment of the aligning table according to the invention is shown. In this case the holding-down elements of the upper sheet guide 14 are constructed as high-webbed vertically upright riveted spring bands 56 corrugated in the conveying direction. In this embodiment as well the outermost holding-down element 22 is constructed as U-profile open towards the surface of the sheet 11. In this embodiment as well the spring bands 56 are slidingly mounted via slide blocks 28, 30, 32, 34 and 36 on the guide bar 24 and the slide blocks 28', 30', 32', 34' and 36' on the guide bar 26. FIG. 6 shows how the slide blocks are mounted on the spring bands 56. The slide block 34 shown therein is connected by means of two screws 68 to the spring band 56.

Compared with the aligning tables of the prior art the aligning table 10 explained with reference to the two embodiments permits a substantially simpler operation. Corresponding to the sheet size and the nature of the paper of the sheets 11 to be transported the upper holding-down elements 20 and 22 and 56 are brought into their desired position by bringing the stops 42, 44, 46, 48 and 50 into the desired position on the stop guide bar 38 or the stop guide bar 40 and clamping them by means of the clamp screws 54. The holding-down elements 20 and 22 of the upper sheet guide 14 are pressed due to the spring force of the pressure springs 52 with their respective slide blocks 28, 30, 32, 34 and 36 and 28', 30', 32', 34' and 36' against the stops arranged in the desired position. In this working position the sheets 11 are transported between the lower sheet guide 12 and the upper sheet guide 14.

Now, if it is necessary to remove an interfering sheet from the aligning table 10, the holding-down elements 20 and 22 are pushed beyond the grip 55 arranged on the outermost holding-down element 22 on the guide bars 24 and 26 towards the side wall 16 so that the interfering sheet is freely accessible and can be removed.

The holding-down elements 20 and 22 of the upper sheet guide 14 are locked in the laterally displaced position, the sheet removal position, by means of the detent mechanism described above consisting of the detent bolt 58 and the blocking slide 60. This enables removal of the interfering sheet with both hands. After removal of the interfering sheet the blocking slide 60 is released again against the spring force of the tensile spring 66 and the holding-down elements 20, 22, supported by the spring force of the pressure springs 52, are pushed back exactly into their working position.

It is particularly advantageous that even during the working operation of the aligning table 10 spacing corrections of the holding-down elements 20 and 22 are possible by laterally adjusting the stops 42, 44, 46, 48 and 50.

Figure 7:
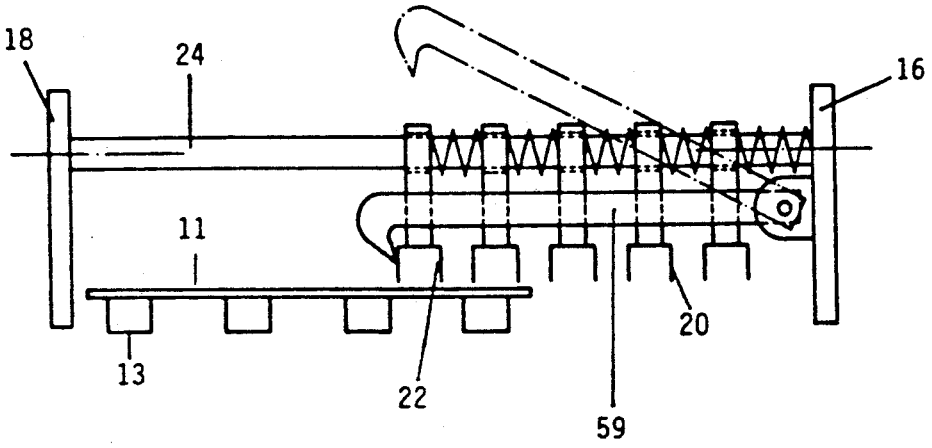
FIG. 7 is a schematic side elevation of an alternative detent means for locking the holding-down elements.

An alternative detent arrangement for locking the holding-down elements 20, 22 of the upper sheet guide 14 when they are shifted into the sheet removal position to the side wall 16 is shown in FIG. 7. In this case, instead of the detent bolt 58 and the detent means 60, 66 cooperating therewith a locking pawl 59 is pivotally mounted on the machine frame and in the lowered state engages over the front edge of the outermost holding-down element 22.

The invention is not restricted to the embodiments described above. For example, within the scope of the present invention, the stop guide bars 38, 40 can be arranged laterally adjacent but also above the guide bars 24, 26. The side walls 16, 18 also need not be made as uninterrupted rigid walls; they may be formed by round or flat bars connected to give a rigid frame.

I claim:

1. Aligning table comprising a lower sheet guide and an upper sheet guide defined by two side walls extending in a conveying direction, a plurality of holding-down elements between said side walls aligned in the conveying direction, and at least one guide bar connecting said side walls together, said guide bar extending perpendicularly to said side walls, said holding-down elements being slidable when mounted on said guide bar.

2. The aligning table claimed in claim 1, wherein said holding down elements are mounted respectively by slide blocks with blocking areas of different lengths on said at least one guide bar, and including a respective stop guide bar extending parallel to said at least one guide bar, and a plurality of stops mounted in spaced relation on said stop guide bar, said stops corresponding in number to the number of holding-down elements and having blocking areas of different lengths, said blocking areas of said slide blocks and said blocking areas of said stops being so dimensioned and arranged that each stop in a working position forms a respective block for a slide block associated therewith.

3. The aligning table claimed in claim 2, including pressure spring means arranged between a side wall and said at least one slide block adjacent thereto and between further slide blocks, said pressure spring means pressing said slide blocks against said stops associated therewith.

4. The aligning table claimed in claim 2 or 3, including clamping screw means for locking said stops on their respective stop guide bar.

5. The aligning table claimed in claim 1, 2 or 3, wherein said holding-down elements have cross-sectional configurations such that there is a smallest side face, and said elements are so aligned that said smallest side face of their cross-sectional configuration points in the direction of said lower sheet guide.

6. The aligning table claimed in claim 5, wherein said holding-down elements have U-shaped cross-sections which are open toward said lower sheet guide.

7. The aligning table claimed in claim 1, 2 or 3, wherein an outer said holding-down element has a U-shaped cross section and the remaining holding-down elements are constructed as high-webbed vertically upright riveted spring bands corrugated in the conveying direction.

8. The aligning table claimed in claim 1, 2 or 3, including detent means for releasably locking said holding-down elements in a sheet removal position.

9. The aligning table claimed in claim 8, including a fixed detent bolt extending from one side wall transversely of the conveying direction to said aligning table, and wherein said detent means is arranged on said holding-down element furthest remote from said side wall in such manner as to engage said detent bolt.

10. The aligning table claimed in claim 9, wherein a blocking slide is disposed as said detent means on said furthest remote holding-down element.

11. The aligning table claimed in claim 8, including a locking pawl for locking said holding-down elements in said sheet removal position.

* * * * *